US006089330A

United States Patent [19]

Miescher et al.

[11] Patent Number: 6,089,330

[45] Date of Patent: Jul. 18, 2000

[54] DEVICE FOR TRANSMITTING PULSED AXIAL PERCUSSIONS TO A BORE-FORMING TOOL

[75] Inventors: Stefan Miescher, Eschen, Liechtenstein; Gerhard Binder, Dornbirn, Austria

[73] Assignee: Hilti Aktiengesellschaft, Schaan, Liechtenstein

[21] Appl. No.: 09/016,377

[22] Filed: Jan. 30, 1998

[30] Foreign Application Priority Data

Jan. 30, 1997 [DE] Germany ..... 197 03 334

[51] Int. Cl.[7] ..... B25D 11/00

[52] U.S. Cl. ..... 173/132; 173/104; 173/128; 173/203

[58] Field of Search ..... 173/201, 203, 173/93.5, 93, 29, 46, 104, 109, 114, 128, 132, 133

[56] References Cited

U.S. PATENT DOCUMENTS

| | | | |
|---|---|---|---|
| 1,665,173 | 4/1928 | Misener | 173/29 |
| 3,123,156 | 3/1964 | Gapstur | 173/203 |
| 3,149,681 | 9/1964 | Drew | 173/203 |
| 3,650,336 | 3/1972 | Koehler | 173/201 |
| 3,837,410 | 9/1974 | Maxwell | 173/109 |
| 4,450,919 | 5/1984 | Cousineau | 173/29 |
| 4,489,792 | 12/1984 | Fahim et al. | 173/29 |
| 5,094,133 | 3/1992 | Schreiber | 173/29 |

*Primary Examiner*—Scott A. Smith
*Attorney, Agent, or Firm*—Brown & Wood, LLP

[57] ABSTRACT

A device for transmitting pulsed axial percussions to a drill (12) and including a housing (2) one end of which is releasably connectable with a housing (3) of a hand-held rotary drill, a rotation transmitting element (7, 9) rotatably supported within the housing (2) and operatively connected with a rotatable spindle (4), which projects from the rotary drill housing (3), for joint rotation therewith, a chuck (11) provided at an end of the device housing (2) opposite to the one end for receiving the drill (12), a reciprocating hammer member (15) movable into an abutting engagement with a trailing end of the drill (12), and a hammer mechanism (17–20; 21–24) arranged within the device housing (2) for imparting pulsed axial percussions to the hammer member (15) and connected with the rotation transmitting element (7, 9) for generating the pulsed axial percussions.

6 Claims, 2 Drawing Sheets

DEVICE FOR TRANSMITTING PULSED AXIAL PERCUSSIONS TO A BORE-FORMING TOOL

BACKGROUND OF THE INVENTION

1. Field of the Invention

The present invention relates to a device for transmitting pulsed axial percussions to a bore-forming tool, in particular, a drill. The present invention also relate to a method of forming attachment points with such a device.

2. Description of the Prior Art

The use in attachment and extraction technologies of hand-held tools which are provided with a rotary drive for a bore-forming tool, in particular, a drill and which are equipped with a hammer mechanism for generating pulsed axial percussions transmittable to the drill is well known. The axial percussion enhance the extracting effect of the drill, in particular, during drilling of brittle breakable constructional components such as, e.g., concrete, sandstone and the like. A hammer drill of the assignee of the present invention, which is equipped with an electro-pneumatic hammer mechanism which generates axial percussions having a relative high single percussion energy, can serve as an example of a rotary percussion drill used for drilling of the above-discussed materials. For use in the semi-professional field, in particular, by handimen, the so-called percussion drills are equipped with a mechanical hammer mechanism. As mechanical hammer mechanisms, cushioned cam hammer mechanisms, cushioned strap hammer mechanisms, or simple ratchet hammer mechanism, which generate axial percussions with low single percussion energies and which prove to be adequate, can be used.

Another type of hand-held tools has only a rotary drive for a tool received in the hand-held tool chuck. Such tools include, e.g., screw tools or drilling screws produced by the assignee of the present invention. Such hand-held tools can be used for forming bores in ductile breakable constructional materials such as, e.g., wood or metal. For forming bores in brittle, breakable, hard constructional components such as, e.g., concrete, hand-held tools without a percussion-generating hammer mechanism can hardly be used.

A user of a hand-held tool without a hammer mechanism can come across a case when a bore has to be formed in a hard material. However often in such a case, no rotary percussion tool with a hammer mechanism is available. Therefore, there exists a need to be able to form bores in brittle breakable constructional components when a hand-held tool having only a rotary drive is available. Further, a user of a rotary percussion tool with a hammer mechanism, in particular with electro-pneumatic hammer mechanism, can in many cases, e.g., when bores in brick masonry need be formed, encounter a problem when the single percussion energy provided by the hammer mechanism is too high for a particular use. Usually, in such a case, the bore is formed without the percussion back up. This increases the amount of time necessary to form a bore. In addition, the power of a highly efficient rotary percussion tool is not used to a full extent. Therefore, there exists a need to be able to use the capacity of a rotary percussion drill to the fullest in cases when the single percussion energy provided by the hammer mechanism should be limited.

Further, the assignee of the present invention suggested to improve the known attachment technology of direct mounting, when a nail-shaped attachment member is driven into a constructional material, e.g., steel or concrete, with an explosive powder force, and an attachment member is anchored in a preliminary formed bore by using additional means. In accordance with this technology, the formation of a bore in a constructional component and the anchoring of a tubular attachment member in the bore are effected in a single operational step. It is desirable to be able to use the new technology also when anchoring of an attachment member in a brick masonry is necessary. Therefore, a device is needed which would permit to use the known rotary percussion drill having a hammer mechanism for generating pulsed axial percussions with the new direct attachment technology for forming attachment points also in a brick masonry.

SUMMARY OF THE INVENTION

The objects of the present invention, which were discussed above, and further objects, which would become apparent hereinafter, are achieved by providing a device for transmitting pulsed axial percussions to a drill including a housing one end of which is releasably connected with a housing of hand-held rotary drill, and rotation transmitting means rotatably supported within the housing and operatively connected with a rotatable spindle, which projects from the rotary drill housing, for joint rotation therewith. A chuck is provided at the opposite end of the device housing for receiving the drill. A reciprocating hammer member is movable into an abutting engagement with a trailing end of the drill, and a hammer mechanism is arranged within the device housing for imparting pulsed axial percussions to the hammer member. The hammer mechanism is connected with the rotation transmitting means for generating the pulsed axial percussions.

The device according to the present invention is designed as an adapter connectable with the rotatable spindle of a rotary drill projecting out of the rotary drill housing. To this end, the device or the adapter housing and the rotary drill housing are equipped with elements of a quick-change mechanism such as used, e.g. in hand-held tools produced by the assignee of the present invention for changing drill-receiving chucks. A hammer mechanism, which is arranged inside of the adapter, generates pulsed axial percussions as a result of rotational movement of the hand-held tool spindle which projects from the tool housing and is operatively connected with the hammer mechanism. In this way, e.g., a drill screw having only a spindle rotary drive, without any hammer mechanism can be equipped with the inventive device for forming bores in a brittle, breakable, hard constructional component e.g., concrete, with a percussion back-up. The axial percussions are generated in the adapter, as a result of the rotational movement of the spindle, and are transmitted to a drill secured in a chuck with which the adapter is provided. The inventive adapter can also be used with rotary percussion drills which are equipped, e.g., with a hammer mechanism generating axial percussions having a relatively high single percussion energy. Such drills are produced by the assignee of the present invention and are equipped with an electro-pneumatic hammer mechanism. In the case when axial percussions with a smaller single percussion energy are required, the hammer mechanism of the hand held tool can be turned off, with the axial percussions being provided only by the hammer mechanism of the adapter. Thereby, in a case when a relative high single percussion energy of the axial percussions is undesirable, e.g., when forming a bore in a brick masonry, the bore still can be formed with some percussion back-up. The adapter device according to the present invention, permits to use the known rotary percussion drill, which is equipped with a hammer mechanism, with the new, proposed by the assignee of the present invention, direct attachment technology. In this case, the hammer mechanism of the rotary percussion drill is also used. Thus, there is provided a combination formed of a hand-held tool and the invention device which simultaneously generates two different types of axial percussions. The hammer mechanism of the adapter generates axial percussions having a smaller single percussion energy which is used for percussion back-up of the drilling action of the drill. The frequency of the axial percussions of the hammer mechanism of the adapter is adjusted by selecting an appropriate transmission ratio when converting the rotational movement of the spindle into operational movement of the adapter hammer mechanism. Usually, the frequency of the axial percussions, which are generated by the adapter hammer mechanism, is selected so that it is higher than the frequency of the axial percussions which are generated by a hand-held tool hammer mechanism. Advantageously, the electro-pneumatic hammer mechanism of a hand-held tool generates axial percussions having a relatively greater single percussion energy which is used for a simultaneous drive-in of a tubular attachment member into the drilled bore.

According to a preferred embodiment of the present invention, the hammer member that transmits the axial percussion to the drill does not form part of the hammer mechanism. Rather, it is impacted by a hammer which, due to the connection of the hammer mechanism with the rotation transmitting means, periodically axially reciprocates and imparts pulsed axial percussions to the hammer member. By this separation of the hammer member, which cooperates with the drill, from the hammer of the hammer mechanism, an effective separation of rotatable components from components, which effect a pure translatory movement, is achieved. This permits to simplify the construction of the hammer mechanism of the adapter and the adapter itself.

According to an embodiment of the inventive device, the hammer forms a component of a cushioned cam hammer mechanism which includes a cam ring rotatably supported in the adapter housing and driven by the hammer member. The cam ring without a possibility of rotation and an axial displacement relative to the housing. Upon rotation of the hammer relative to the toothed locked washer, the toothings slide relative to each other, resulting in periodical, pulsed axial displacement of the hammer. The maximum axial displacement of the hammer corresponds to the sum of tooth heights of the engaging each other toothings. The ratchet hammer mechanisms are well known from the state of the art and are used in relatively cheap percussion drills used by handimen. They have proved themselves in the field, and their manufacturing is particularly simple and economical. The axial percussions generated by the ratchet hammer mechanisms have a relatively small single percussion energy. Therefore, they can be produced with a relatively high frequency.

According to an advantageous embodiment of the present invention, the rotation transmitting means includes a sleeve supported within the device housing and connectable with the rotatable spindle of the drill tool for joint rotation therewith. The axial rotational movement of the sleeve is transmitted to an intermediate anvil which is arranged in the device housing and is axially displaceable relative to both the hammer member and the sleeve. Forming the rotation transmitting means as a plurality of cooperating components permits to obtain a large number of degrees of freedom in the hammer mechanism.

Advantageously, the hammer member has a wedge-like shape and is displaceable in an axial slot provided in the intermediate anvil, with a circumference of the hammer member extending beyond both sides of the axial slot. The hammer member is driven by the intermediate anvil. The length of the axial slot is larger than the sum of an axial lengths of the hammer member and its maximal displacement path resulting from displacement of the hammer member which is axial percussions transmitted thereto from the hammer mechanism. Thereby, the intermediate anvil decouples axial percussions which are transmitted from the hammer mechanism to the hammer member. The intermediate anvil is rotably driven by sleeve which is arranged within the adapter housing and is connected with the rotatable spindle of the hand-held tool. Advantageously, the axial length of the intermediate anvil is so selected that it projects from the device housing. Preferably, the chuck for receiving the drill is provided on the projecting, from the housing, portion of the intermediate anvil.

The inventive adapter advantageously is so formed that it can be used with a hand-held tool that, in addition to a rotary drive for the rotatable spindle, has a hammer mechanism for generating pulsed axial percussions. At that, on one hand, the rotational movement of the spindle is transmitted to the intermediate anvil and the drill. On the other hand, axial percussions, which are generated by the hammer mechanism of the hand-held tool are also transmitted to the intermediate anvil. This is effected, in particular with an electro-pneumatic hammer mechanism, by the anvil of the hammer mechanism of the hand-held tool which is displaceable within the spindle formed as a tubular guide, and which periodically impacts on the trailing end of the intermediate anvil. At its opposite, leading end, the intermediate anvil has a stop shoulder. When in use, the stop shoulder is supported against an attachment member to be driven into the drilled bore to transmit to the attachment member the axial percussions generated by the hammer mechanism of the hand-held tool.

When the direct attachment technology is used, the attachment point is formed with a combination rotary percussion drill-adapter. The hammer mechanism of the hand-held tool, which is advantageously formed as an electro-pneumatic hammer mechanism, generates axial percussions with a relatively large single percussion energy. The adapter hammer mechanism generates, upon being driven by the spindle of the hand-held tool, high frequency axial percussions the single percussion energy of which, however, is relatively small. In the modified direct attachment technology, the drill is advanced axially through the attachment member. The hammer member imparts to the drill axial percussion which are generated by the adapter hammer mechanism. The axial percussions, which are generated by the hammer mechanism of the hand-held tool are transmitted directly to the attachment member which is immediately driven into the drilled bore. The axial percussions which are generated by the adapter hammer mechanism, are characterized by a relatively small single percussion energy but by high percussion frequency, which permits to form a bore in a brick masonry with a high efficiency, without destroying the constructional component. The axial percussions, which are generated by the hammer mechanism of the hand-held tool have, however, a high single percussion energy but a low frequency. They are transmitted to the tubular attachment member. Thereby, the frictional force between the bore wall and the attachment member is overcome.

BRIEF DESCRIPTION OF THE DRAWINGS

The features and objects of the present invention will become more apparent, and the invention itself will be best understood from the following detailed description of the preferred embodiments when read with reference to the accompanying drawings, wherein.

DETAILED DESCRIPTION OF THE PREFERRED EMBODIMENTS

Figures 1, 2:
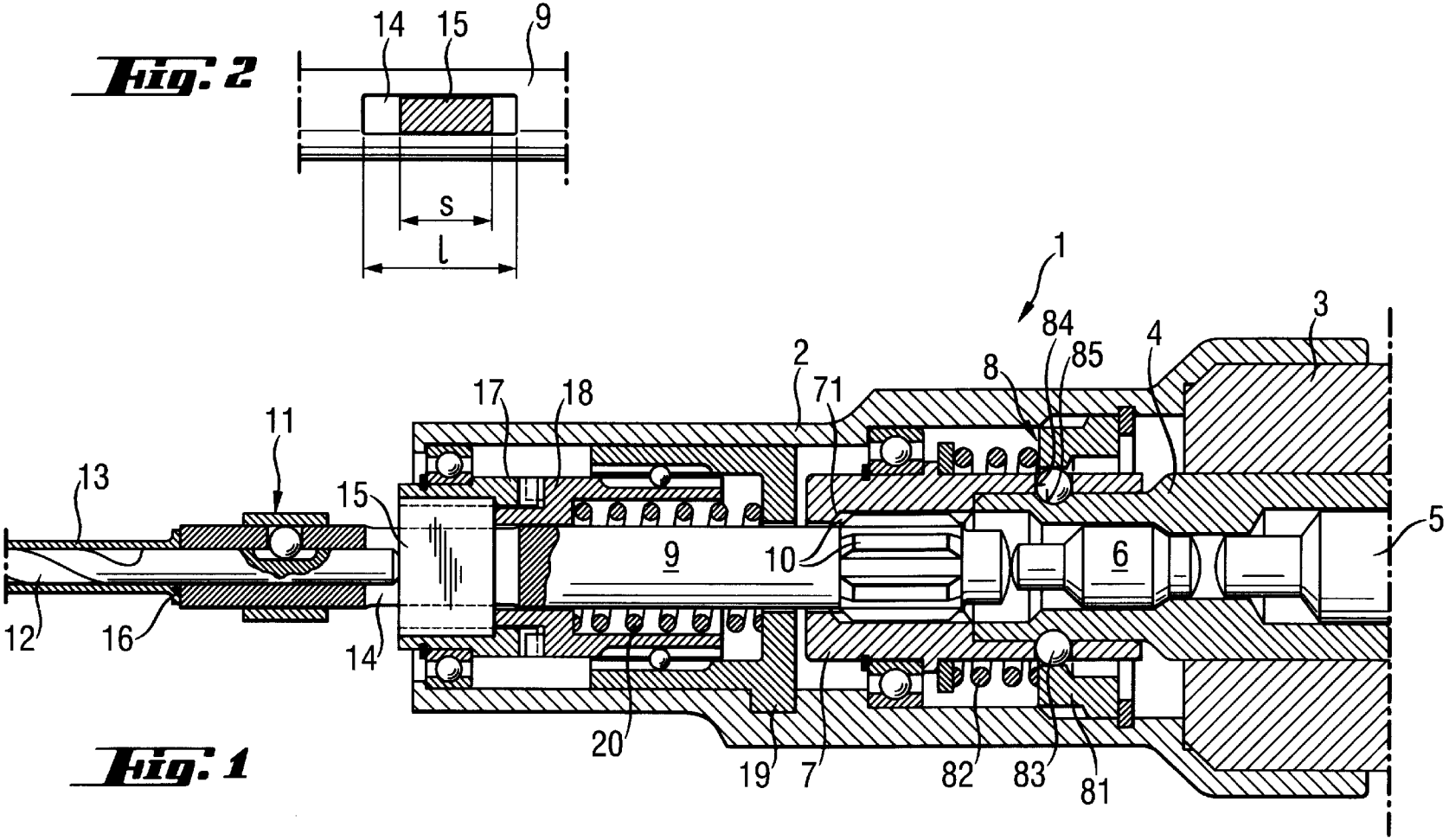
FIG. 1 shows an axial cross-sectional view of a first embodiment of a device according to the present invention for transmitting axial percussions to a drill.
FIG. 2 shows a view of a detail of the transmitting device shown in FIG. 1.

A device 1 according to the present invention, which is used with a hand-held tool for transmitting percussion to a bore-forming tool and which is shown in FIG. 1, is attached to a free end of a rotatable spindle 4, which projects from a housing 3 of the hand-held tool, instead of a chuck. The inventive device is particularly adapted for use with hand-held rotary percussion tools with an electro-pneumatic hammer mechanism. At that, the rotatable spindle 4 is formed as a guide tube in which an anvil 6 is subjected to axial percussions from a periodically advanced percussion piston 5. A housing 2 of the transmitting device or adapter 1 is secured to the housing 3 of the hand-held tool without a possibility of an axial displacement and rotation relative to the housing 3. To this end, a locking mechanism 8 is provided, which connects rotation transmitting means, which are arranged in the device housing 2, with the rotatable spindle 4. The locking mechanism 8 provides for positioning of the device housing 2. The attachment of the housing 2 to the housing 3 without the possibility of rotation of the housing 2 relative to the housing 3 is effected, e.g., by a form-locking connection. The locking mechanism 8 corresponds to quick-change mechanisms used with known hand-held tools having replaceable chucks. The locking mechanism 8 includes a locking sleeve 81, which is displaceable in the housing 2 against a biasing force of a spring 82 and which cooperates with at least one locking body 83 held in a hole 84 formed in a rotation transmitting sleeve 7 which is rotatably supported in the housing 2. In the embodiment shown in FIG. 1, there are provided two locking bodies 83 which advantageously are formed as rolling bodies.

The spring-biased locking sleeve 81 forces the locking bodies 83 into locking grooves 85 provided in an outer surface of the rotatable spindle 4. This provides for connection of the housing 2 with the housing 3 without the possibility of an axial displacement and rotation of the housing 2 relative to the housing 3. The locking mechanism 8 can be quickly released by an axial displacement of the locking sleeve 81 against the biasing or return force of the spring 82. This provides for quick removal of the percussion transmitting device or adapter 1 and is replacement, e.g., with a chuck.

With a mounted adapter 1, the rotation transmitting sleeve 7 is fixedly connected with the spindle 4. In the sleeve 7, an intermediate anvil 9 which is rotatable supported in the housing 2, is axially displaceable. Rotation transmitting strips 10, which are provided on the inner surface of the rotation transmitting sleeve 7 and on the circumference of the intermediate anvil 9 and which engage with each other, transmit the rotational movement of the spindle 4 to the intermediate anvil 9. The intermediate anvil 9 is provided at its end, which projects from the adapter housing 2, with a chuck 11. The rotational movement of the spindle 4 is transmitted to a drill 12 received in the chuck 11.

In its region located in the vicinity of the end of the adapter 1 adjacent to the chuck 11, the intermediate anvil 9 is provided with an axial guide slot 14 in which a wedge-shaped hammer member 15 is displaceable. The hammer member 15 is located adjacent to drill 12 received in the chuck 11. The wedge-shaped hammer member 15 projects beyond the circumference of the intermediate anvil 9 on both sides of the slot 14 and drives a cam ring 17 of a cushioned cam hammer mechanism rotatable supported in the housing 2. The cam ring 17 is rotatably supported in the adapter housing 2 without a possibility of an axial displacement therein. The hammer member 9 cooperates with a hammer 18 which is provided with a cam complementary to the cam ring 17. The hammer 18 is secured against rotation in a guide sleeve 19 but with a possibility of an axial displacement therein. The guide sleeve 19 is fixedly connected with the housing 2. Upon rotation of the cam ring 17 relative to the hammer 18, the inclined surfaces on the cam and the complementary cam slide relative to each other, with the hammer 18 displacing axially against a biasing force of spring 20 extending between the hammer 18 and the guide sleeve 19. When the cams release the hammer 18, it is advanced by the spring 20 toward the hammer member 15 until it contact the hammer member 15 and effects a percussion. From the wedges-shaped hammer member 15, the axial percussion is transmitted to the drill 12 which is secured in the chuck 11. In a modified embodiment of the cushioned cam hammer mechanism, the pre-load of the spring 20 can be varied by changing an axial position of the guide sleeve 19 in the adapter housing 2. To this end, adjustment device can be provided at the outer side of the housing 2. By changing the pre-load of the spring 20, the return force, with which the floating hammer 18 is advanced toward the hammer member is changed. With this, the single percussion energy of the axial percussions can be changed.

The axial percussions, which are generated by the hammer mechanism of the hand-held tool, are transmitted by the anvil 6 displaceable within the spindle 4 to the intermediate anvil 9, which is rotatably supported in the adapter housing 2 with a possibility of a limited axial displacement. The axial displacement of the intermediate anvil 9 is limited, in the embodiment of FIG. 1, by a stop shoulder 71 on the rotation transmitting sleeve 7. The intermediate anvil 9 transmits the axial percussions generated by the hammer mechanism to a tubular attachment member 13. As shown in FIG. 1, the drill 12 is axially displaceable through the tubular attachment member 13. The drill 12 is located adjacent to the hammer member 15 which transmits the axial percussion generated by the hammer mechanism which is arranged in the housing 2. The tubular attachment member 13 abuts a shoulder 16 formed at the free leading end of the intermediate anvil 9 which is subjected to percussions generated by the hammer mechanism of the hand-held tool.

The axial percussions of the two hammer mechanisms are decoupled. As shown in FIG. 2, the hammer member 15 is freely displaceable in the slot guide 14 formed in the intermediate anvil 9. The length 1 of the slot guide 14 is larger than the sum of the axial lengths of the hammer member 15 and of its maximal displacement path resulting from axial percussions generated by the hammer mechanism 17, 18, 19, 20 and the maximum displacement path of the intermediate anvil 9 which is subjected to axial percussion generated by the hammer mechanism of the hand-held tool. This is insures that the hammer member 15 and the intermediate anvil 9, which are subjected to axial percussions having different frequencies, respectively, cannot contact each other in the axial direction, whereby a percussion transmission between the two parts, the intermediate anvil 9 and the hammer member 15, is prevented.

Figure 3:
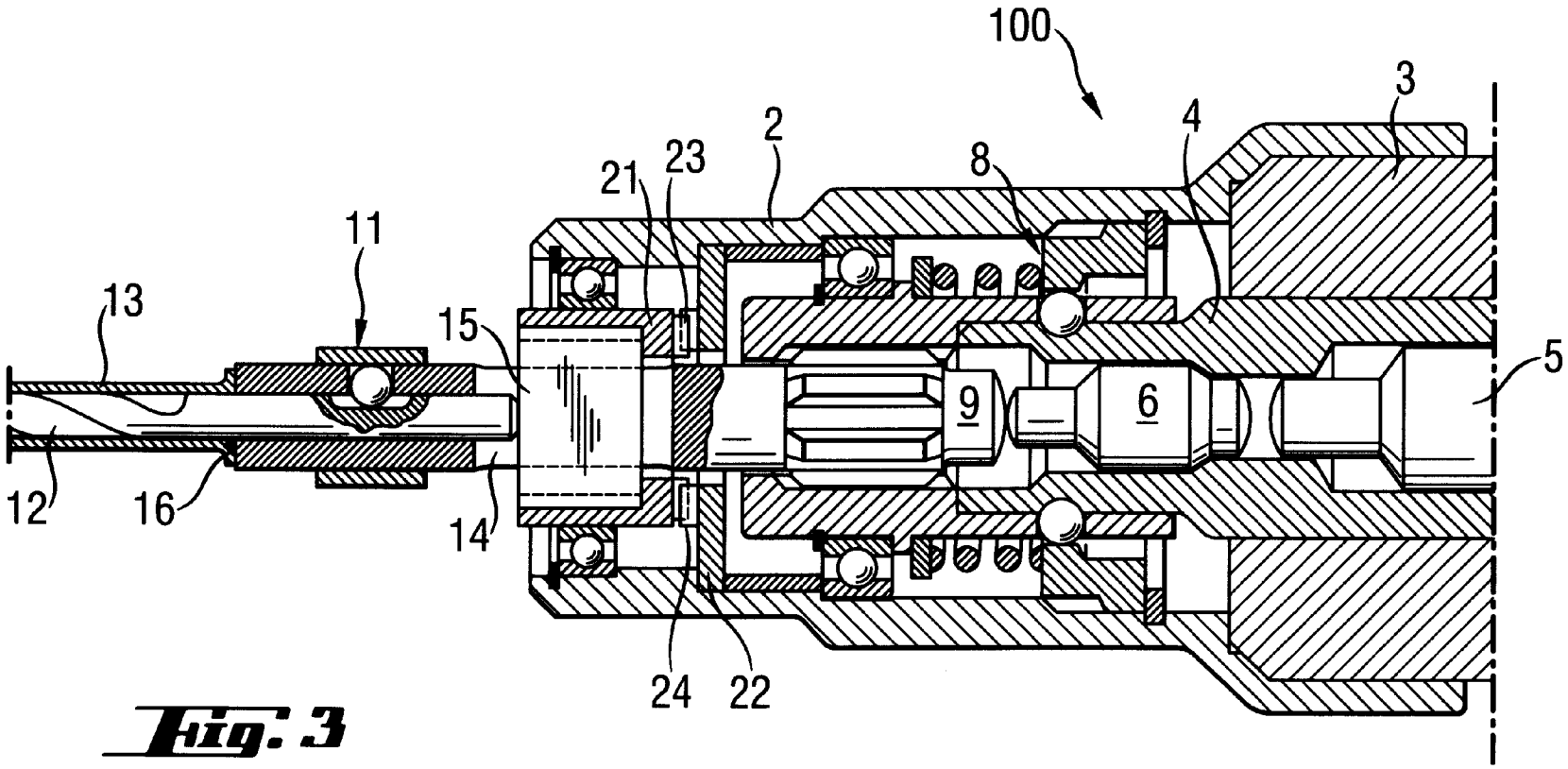
FIG. 3 shows an axial cross-sectional of a second embodiment of a device according to the present invention for transmitting axial percussions to a drill.

The adapter 100, which is shown in FIG. 3, in many respects corresponds to the adapter 1 shown in FIG. 1. The difference lies in the design of the hammer mechanism which is arranged in the housing 2 and generates axial percussions as a result of rotational movement of the intermediate anvil 9, which percussions are transmitted to a drill 12 received in the chuck 11. The hammer mechanism used in this embodiment relates to so-called ratchet hammer mechanisms. The hammer 21 is formed as a sleeve-shaped part rotatably supported in the adapter housing 2. The hammer 21 is rotated by a rotary hammer member 15. At that, an end face toothing 23, which is provided at an end surface of the hammer 21 remote from the hammer member 15, is located opposite a toothing 24 of a toothed lock washer 22 which is secured to the housing 2 without a possibility of rotation and axial displacement relative to the housing 2.

The generated percussion is transmitted to the drill 12 with the wedge-shaped hammer member 15. The intermediate anvil 9 can, as shown in FIG. 3, be operatively connected with the anvil 6 of the hammer mechanism of the hand-held tool. In this way, the intermediate anvil 9 is subjected to axial percussions which are independent on axial percussions of the hammer mechanism 21–24 of the adapter 100. As in the embodiment of the adapter 1 provided with a cushioned cam hammer mechanism, which is shown in FIG. 1, decoupling of the two hammer mechanisms is insured by selecting an appropriate axial length of the intermediate anvil 9. The detail shown in FIG. 2 is equally applicable to the embodiment of an adapter according to the present invention shown in FIG. 3.

An adapter according to the present invention with a hammer mechanism which generates axial percussions as a result of being driven by the rotary drive of the hand-held tool, was described with reference to a hand-held tool with a hammer mechanism and, in particular, with an electro-pneumatic hammer mechanism. The adapter generates pulsed axial percussions which are independent on the function of the hammer mechanism of the hand-held tool. This can thereby be disconnected. Thus, it should be understood that the inventive adapter can be used with hand-held tools which do not have any hammer mechanism.

Through the present invention was shown and described with reference to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A device for transmitting pulsed axial percussions to a drill (12), comprising a housing (2) one end of which is releasably connectable with a housing (3) of a hand-held rotary drill; rotating transmitting means (7, 9) rotatably supported within the drill housing (2) and operatively connected with a rotatable spindle (4), which projects from the rotary drill housing (3), for joint rotation therewith; a chuck (11) provided at an end of the device housing (2) opposite to the one end for receiving the drill (12); a reciprocating hammer member (15) movable into an abutting engagement with a trailing end of the drill (12); and a hammer mechanism (17–20; 21–24) arranged within the device housing (2) for imparting pulsed axial percussions to the hammer member (15), wherein the hammer mechanism (17–20, 21–24) comprises a hammer (18, 21) connectable with the rotation transmitting means (7, 9) for effecting periodical axial reciprocating movements for transmission of the pulsed axial percussions to the hammer member (15), wherein the hammer mechanism is formed as a cushioned cam hammer mechanism comprising a cam ring (17) rotably supported in the device housing (2) and driven by the rotating hammer member (15), the cam ring (17) having cam means operatively connected with complementary cam means provided on the hammer (18) for periodically axially displacing the hammer (18) against a return force of a spring (20), upon being rotated relative to the hammer (18), and wherein the cam ring (17) is rotably supported in the device housing (2) without a possibility of an axial displacement therein, and wherein the return force of the spring (20) is adjustable.

2. A device according to claim 1, wherein the hammer mechanism is formed as a ratchet cam mechanism rotatably supported in the device housing (2) and driven by the rotating hammer member (15), and wherein the hammer (21) is provided at an end face thereof remote from the hammer member (15) with an end face toothing (23) which cooperates with a complementary toothing (24) of a toothed lock washer (22) connected with the device housing (2) without a possibility of rotation and an axial displacement relative thereto.

3. A device for transmitting pulsed axial percussions to a drill (12), comprising a housing (2) one end of which is releasably connectable with a housing (3) of a hand-held rotary drill; rotation transmitting means (7, 9) rotatably supported within the drill housing (2) and operatively connected with a rotable spindle (4), which projects from the rotary drill housing (3), for joint rotation therewith; a chuck (11) provided at the end of the device housing (2) opposite to the one end for receiving the drill (12); a reciprocating hammer member (15) movable into an abutting engagement with a trailing end of the drill (12); and a hammer mechanism (17–20; 21–24) arranged with the device housing (2) for imparting pulsed axial percussions to the hammer member (15), wherein the rotation transmitting means comprises a sleeve (7) supported within the device housing (2) and connectable with the rotable spindle (4) for joint rotation therewith and rotation of which is transmitted by strip shaped rotation transmitting means (10) to an intermediate anvil (9) arranged within the sleeve (7) and axially displaceable relative to the sleeve (7) and the hammer member (15).

4. A device according to claim 3, wherein the hammer member (15) has a wedge-like shape and is displaceable in an axial slot (14) provided in the intermediate anvil (9), with a circumference of the hammer member extending beyond both sides-of the axial slot (14), wherein the hammer member (15) is driven by the intermediate anvil (9), and wherein the axial slot (14) has a length (1) which is larger than the sum of axial lengths of the hammer member (15) and a maximal displacement path thereof resulting from displacement of the hammer member (15) caused by axial percussions transmitted thereto from the hammer mechanism (17–20, 21–24), and of a maximal axial displacement of the intermediate anvil (9).

5. A device according to claim 4, wherein the intermediate anvil (9) projects from the device housing (2) and is provided with the chuck (11) for receiving the drill (12).

6. A device according to claims 3, wherein the handheld rotary drill has hammer means for generating pulsed axial percussions which are periodically transmitted to a trailing end of the intermediate anvil (9) by an axially displaceable anvil (6) arranged within the rotary spindle (4) formed as a guide sleeve, and wherein the intermediate anvil (9) has a free leading end and a stop shoulder (16) provided at the free leading end.

* * * * *